US009981791B2

(12) United States Patent
Feudner et al.

(10) Patent No.: US 9,981,791 B2
(45) Date of Patent: May 29, 2018

(54) MODULAR PACKAGING AND SHIPPING ASSEMBLY

(71) Applicant: Thomas & Betts International LLC, Wilmington, DE (US)

(72) Inventors: Andrew James Feudner, Seattle, WA (US); Ronald David White, Germantown, TN (US)

(73) Assignee: Thomas & Betts International LLC, Wilmington, DE (US)

( * ) Notice: Subject to any disclaimer, the term of this patent is extended or adjusted under 35 U.S.C. 154(b) by 0 days. days.

(21) Appl. No.: 15/376,811

(22) Filed: Dec. 13, 2016

(65) Prior Publication Data

US 2017/0174403 A1 Jun. 22, 2017

Related U.S. Application Data

(60) Provisional application No. 62/270,709, filed on Dec. 22, 2015.

(51) Int. Cl.

| | |
|---|---|
| ***B65D 19/00*** | (2006.01) |
| ***B65D 63/00*** | (2006.01) |
| ***B65D 19/38*** | (2006.01) |
| ***B65D 85/62*** | (2006.01) |

(52) U.S. Cl.

CPC ..... *B65D 63/00* (2013.01); *B65D 19/38* (2013.01); *B65D 85/62* (2013.01)

(58) Field of Classification Search

CPC ..... B65D 63/00; B65D 19/38; B65D 85/62; B65D 71/0096

USPC ..... 206/443, 446, 597, 599, 600, 442, 587; 108/55.1, 55.3, 55.5, 56.1, 56.3, 51.11

See application file for complete search history.

(56) References Cited

U.S. PATENT DOCUMENTS

| | | | | |
|---|---|---|---|---|
| 2,626,456 A * | 1/1953 | Harrison | B60P 7/0884 | 206/597 |
| 3,097,741 A * | 7/1963 | Schwartz | B22D 5/005 | 206/597 |
| 3,671,204 A * | 6/1972 | Foley et al. | B22D 5/005 | 206/597 |
| 4,000,704 A * | 1/1977 | Griffin, Jr. | B65D 19/004 | 108/53.1 |
| 4,050,664 A * | 9/1977 | Daley | B65D 19/0095 | 206/597 |
| 4,148,394 A * | 4/1979 | Bederman | B65D 71/0092 | 206/597 |
| 4,317,517 A * | 3/1982 | Tisdale | B65D 71/0092 | 206/597 |
| 6,168,222 B1 * | 1/2001 | Lacy, III | B65D 71/0092 | 206/597 |
| 6,839,952 B2 * | 1/2005 | Hamilton | B65D 19/0095 | 108/56.1 |

(Continued)

*Primary Examiner* — Luan K Bui

(74) *Attorney, Agent, or Firm* — Hoffmann & Baron, LLP

(57) ABSTRACT

A modular packaging and shipping assembly for a bundled channel product includes a plurality of mounting adapters, each of the plurality of mounting adapters having a flat surface configured to abut the bundled channel product, a plurality of straps designed to wrap both the bundled channel product and the plurality of mounting adapters, and a plurality of mounting platforms, each of the plurality of mounting platforms having a mounting platform recess, which is configured to insertedly accommodate the mounting adapter.

10 Claims, 5 Drawing Sheets

(56) References Cited

U.S. PATENT DOCUMENTS 7,293,509 B2 * 11/2007 Hassell ..... B65D 19/004
108/55.5

* cited by examiner

MODULAR PACKAGING AND SHIPPING ASSEMBLY

FIELD OF THE INVENTION

The present invention relates to modular packaging and shipping assemblies, and more particularly, to modular packaging and shipping assemblies configured to conveniently transport bundled channel products such as metal/non-metal channel bundles.

BACKGROUND OF THE INVENTION

Metal/non-metal channel products and similarly shaped products are normally packaged and shipped (transported) in bundles. Generally, these bundled channel products (e.g., struts) are packaged by arranging a wood cleat at each opposite end of the bundle and wrapping it with straps. Conventional pallets, such as wooden pallets, are commonly used for moving the packaged channel products on the ground and for transporting them from one location to the other. However, existing conventional pallets are unsuitable to ship channel products since they are not designed and configured for mobility of these channel products. Thus, the conventional pallets are prone to cause damages to the channel products. In addition, these pallets are not adequately configured to prevent the channel products from breaking apart in transit.

Accordingly, although various conventional pallets have been used for shipping the channel products, further improvements are possible.

SUMMARY OF THE INVENTION

A modular packaging and shipping assembly for a bundled channel product includes a plurality of mounting adapters, each of the plurality of mounting adapters having a flat surface configured to abut the bundled channel product, a plurality of straps, each of the plurality of straps designed to wrap both the bundled channel product and the plurality of mounting adapters, and a plurality of mounting platforms, each of the plurality of mounting platforms having a mounting platform recess configured to insertedly accommodate the mounting adapter.

These and other aspects of the present invention will be better understood in view of the drawings and following detailed description.

DETAILED DESCRIPTION OF PREFERRED EMBODIMENTS

Figure 1:
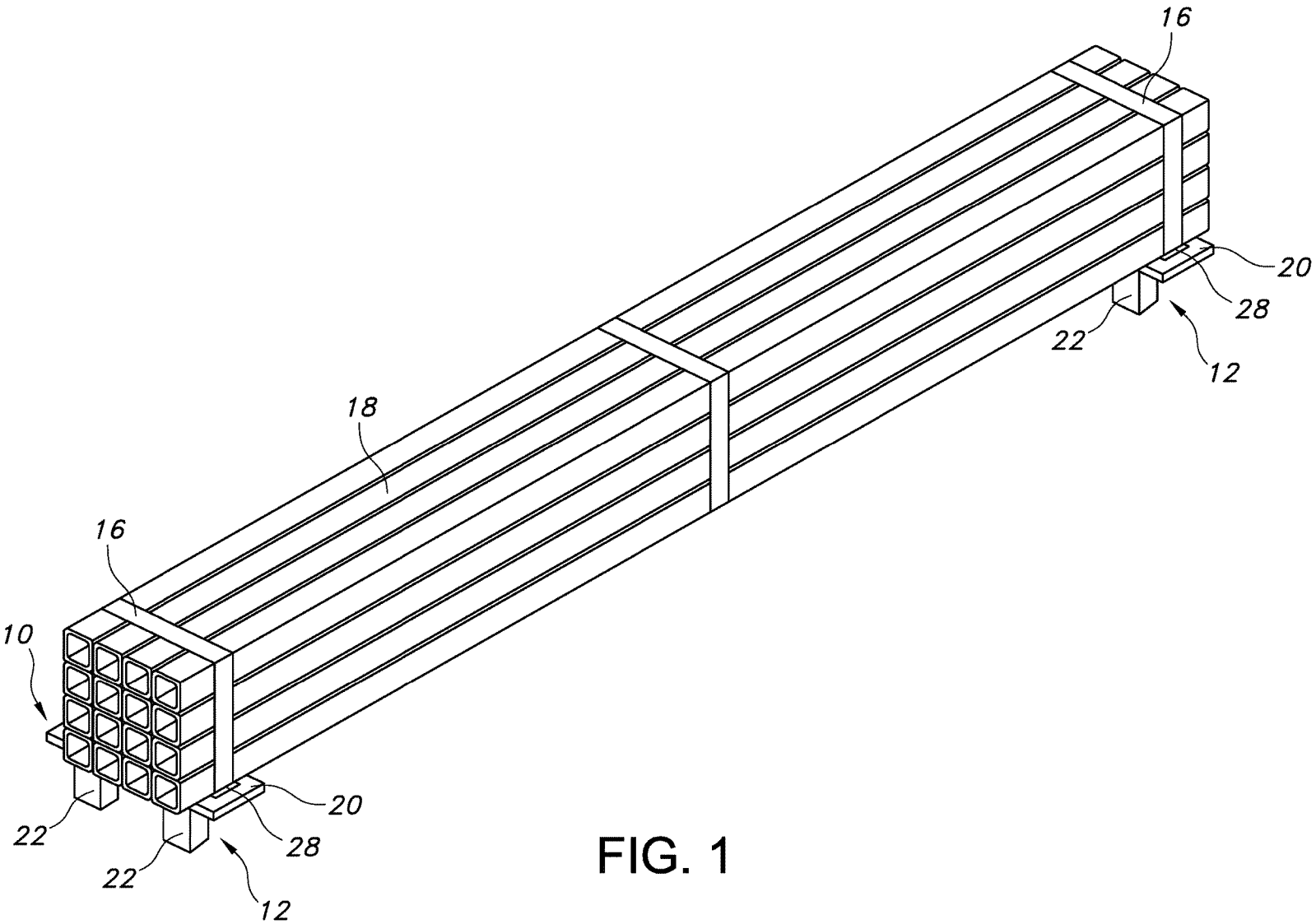
FIG. 1 is a perspective view of a modular packing and shipping assembly, according to an embodiment of the present invention, with a strut bundle mounted to a plurality of mounting platforms.
Figure 2:
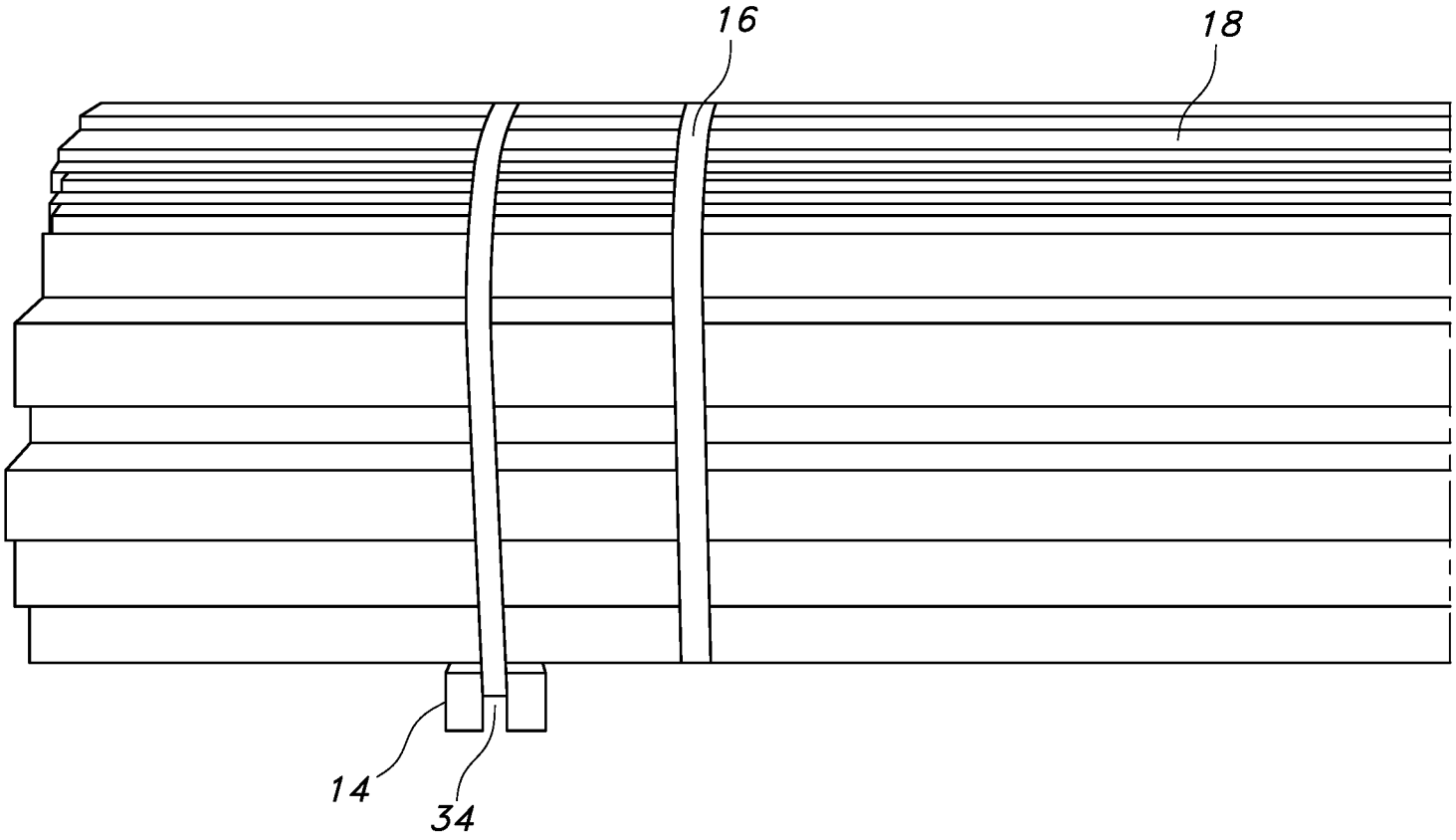
FIG. 2 is a perspective view of the strut bundle in FIG. 1.

According to an embodiment of the present invention, referring to FIGS. 1 and 2, a modular packaging/shipping assembly 10 includes a plurality of mounting platforms 12, a plurality of mounting adapters 14 and a plurality of straps 16. Bundles 18, such as strut (metallic and/or non-metallic channel) bundles shown in FIG. 1, may be mounted on the plurality of mounting platforms 12, and affixed via the plurality of mounting adapters 14 and the plurality of straps 16, which will be described in greater detail below. The present invention is designed and configured to provide superior protection and mobility for shipment and storage of bundled products.

Figure 3:
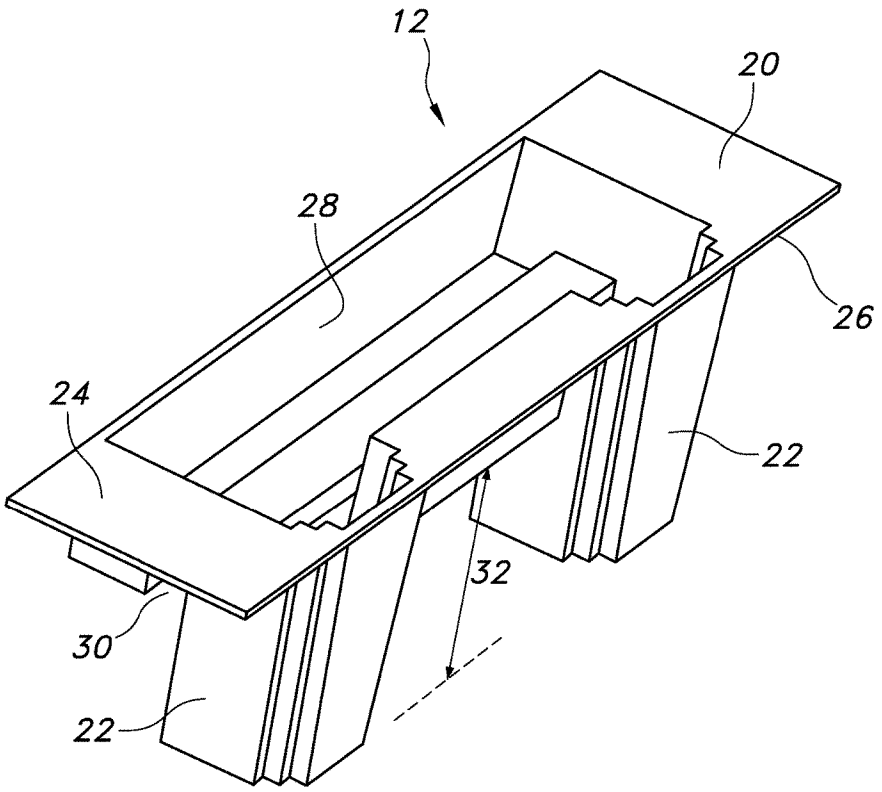
FIG. 3 is a perspective view of the mounting platform of the modular packaging and shipping assembly in FIG. 1.
Figure 4:
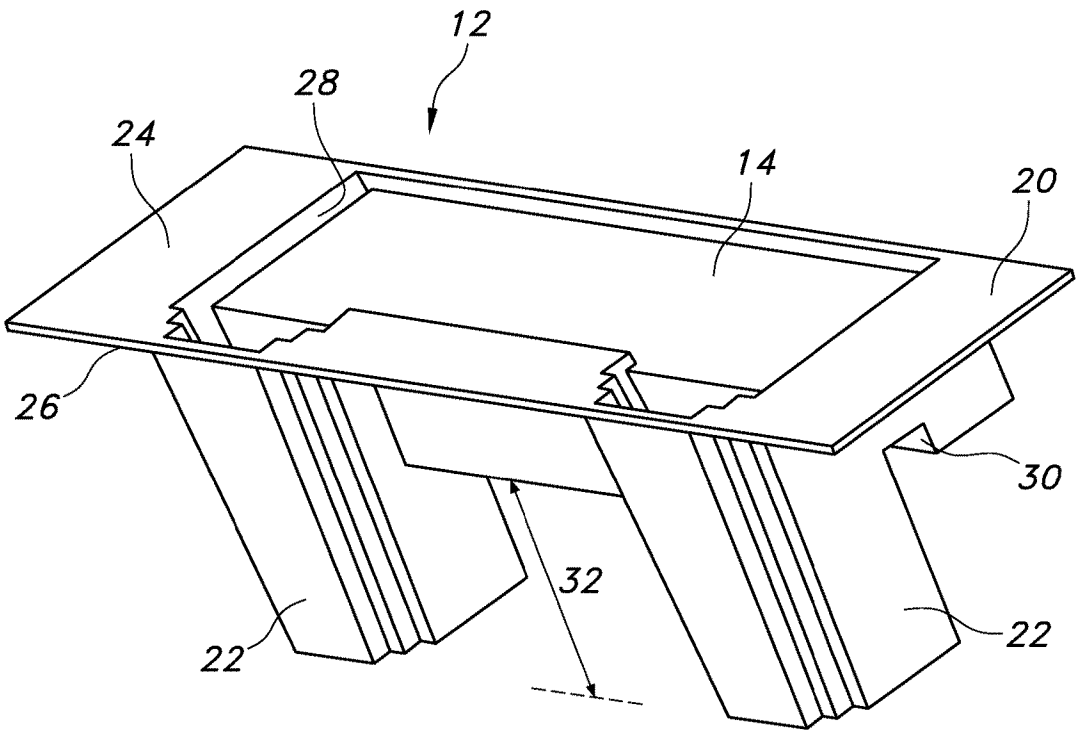
FIG. 4 is a perspective view of the mounting platform of the modular packaging and shipping assembly in FIG. 1, with a mounting adapter placed therewithin.
Figure 5:
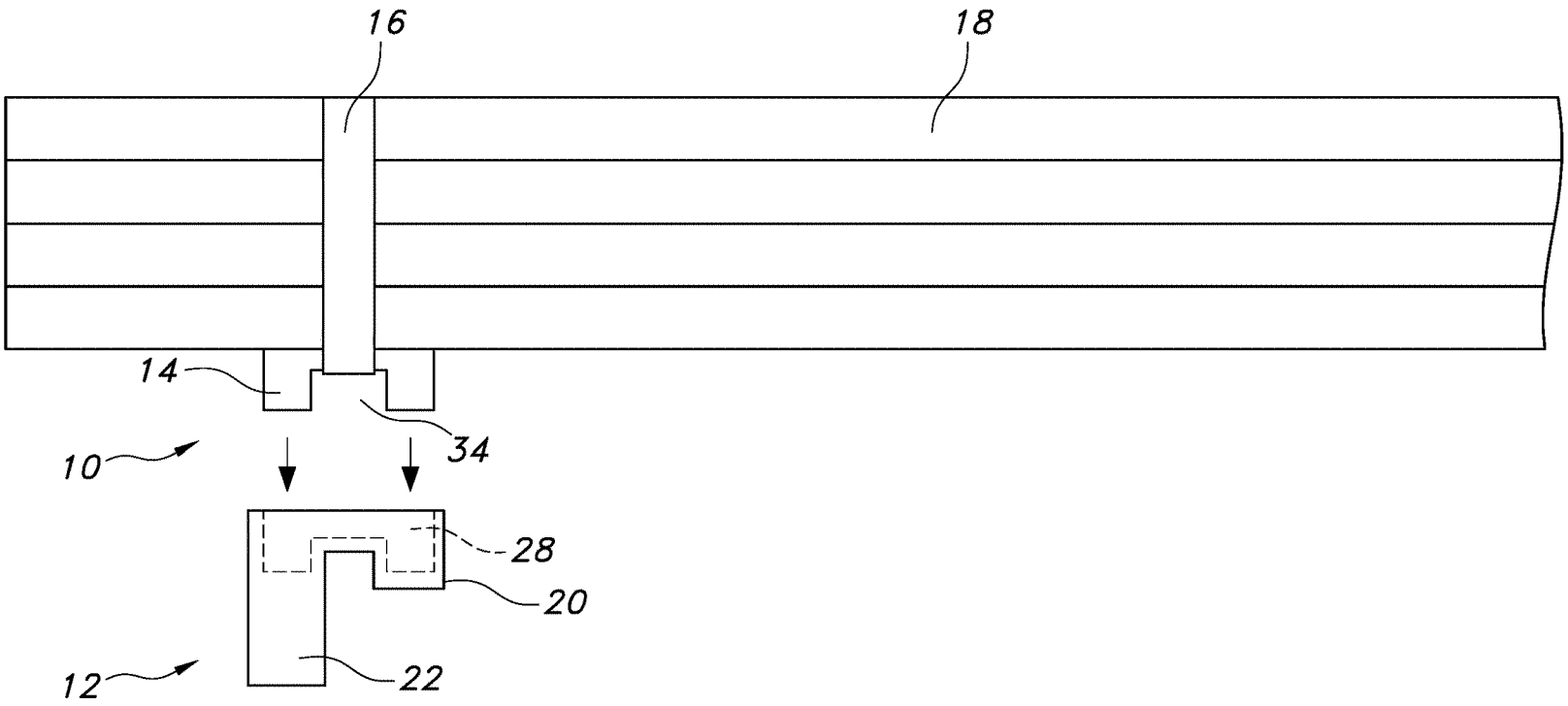
FIG. 5 is a perspective view of the modular packaging and shipping assembly in FIG. 1, with the strut bundle lifted for inserting into the mounting platform.

Referring to FIGS. 3-5 each of the plurality of mounting platforms 12 includes an upper mounting member 20 and a pair of mounting platform legs 22. The upper mounting member 20 is generally rectangular in form and includes a flat top surface 24 and an opposed bottom surface 26. The upper mounting member 20 defines a mounting platform recess 28 in which the mounting adapter IA is inserted to affix the bundle 18, as shown in FIG. 5. An upper mounting member groove 30 is defined on the bottom of the upper mounting member 20. The upper mounting member groove 30 is configured to closely accommodate an outer strap to be placed therein once the bundle 18 is affixed to the plurality of mounting platforms 12. In the depicted embodiment, the mounting legs 22 are formed integrally and extended from a side portion of the bottom of the upper mounting member 20, thereby creating a vertical clearance 32 between the upper mounting member 20 and the ground. In an alternate embodiment, the mounting platform legs 22 can be affixed to the bottom of the upper mounting member 20 by molding. The mounting platform legs 22 can also be attached using other means of adhering.

Advantageously, the vertical clearance 32 promotes safer handling of the bundle 18 and also prevents potential damages to the surfaces of the bundle 18 while in transit. To move the bundle 18 to a desired location, forklift blades (not shown) may be inserted through the vertical clearance 32 and lift the bundle 18 from one side while the other side is still rested on the ground. Thereafter, the bundle 18 can be moved to a desired location by pushing it with a forklift. The vertical clearance 32 is dimensioned to closely engage with the forklift blades to minimize possible damages from contacts between forklift blades (not shown) and the bundle 18.

Preferably, each of the plurality of mounting platforms 12 is made of materials having suitable properties for a desired application, including strength, weight, rigidity, etc. Plastics (e.g., high density polyethylene or polypropylene) are generally preferred. The mounting platform recess 28 is dimensioned to insertedly accommodate the mounting adapter 14. Each mounting platform leg 22 is preferably rectangular in form, although they can be in any shape adapted to support the weight of the bundle 18. The mounting platforms 12 are generally applied to opposing end portions of the bundle 18, although additional mounting platforms 12 may also be applied to anywhere along the length of the bundle 18.

Referring more particular to FIGS. 2 and 4, each of the plurality of mounting adapters 14 is rectangular in form, having a rectangular block shape. A mounting adapter groove 34 is defined in the bottom surface of each of the plurality of the mounting adapter 14, approximately in the middle, such that a part of the strap 16 may be accommodated therein.

The plurality of straps 16 are designed to surround and wrap the bundle 18 to prevent it from breaking apart in transit. Before wrapping the bundle 18 with the plurality of straps 16, the plurality of mounting adapters 14 are arranged such that a substantially flat top surface of each of the plurality of mounting adapters 14 abuts the bottom of the bundle 18. Thereafter, the straps 16 are applied by extending transversely around the bundle 18 and the mounting adapters 14 (via the mounting adapter groove 34), with the straps 16 having their ends connected by the usual seals, or other conventional fastening means.

Each of the plurality of straps 16 is preferably made out of plastic and has sufficient strength and flexibility to hold the bundle 18 in place to prevent damages in transit. Each of the plurality of mounting adapters 14 is dimensioned to be closely arranged to the bottom of the bundle 18, with the width of the each of the plurality of mounting adapters 14 being equal or slightly less than the width of the bundle 18. Contours of the mounting adapter groove 34 are configured to closely accommodate the strap 16 to be placed therein.

In use of the modular packaging/shipping assembly 10, first, the plurality of mounting adapters 14 are arranged such that the flat top surface of each mounting adapter 14 abuts the bottom of the bundle 18. Then, the plurality of straps 16 are applied to the bundle 18 by extending transversely around both the bundle 18 and the mounting adapters 14. With the plurality of mounting adapters 14 and the plurality of straps 16 applied to the bundle 18, it is lifted up with a forklift (not shown) such that the plurality of mounting platforms 12 may be placed underneath the bundle 18. Thereafter, as illustrated in FIGS. 1 and 5, the bundle 18 is mounted onto the plurality of mounting platforms 12 by inserting each of the mounting adapters 14 into each corresponding mounting platform recess 28 of the mounting platform 12.

From the foregoing, it will be appreciated that a modular packaging/shipping assembly according to the present invention easily and conveniently ships bundles of products such as strut/channel, while minimizing or eliminating damages to the products in transit.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A modular packaging and shipping assembly for bundled channels, the modular packaging and shipping assembly comprising:

a plurality of mounting adapters, each of the plurality of mounting adapters having a flat surface configured to abut the bundled channels;

a plurality of straps, each of the plurality of straps designed to wrap both the bundled channels and the mounting adapter; and a plurality of mounting platforms, each of the plurality of mounting platforms including an upper mounting member having a top surface and a bottom surface, wherein a mounting platform recess is defined within the upper mounting member of the mounting platform and is configured to insertedly accommodate the mounting adapter.

2. The modular packaging and shipping assembly of claim 1, wherein each of the plurality of mounting platforms further includes a pair of mounting platform legs.

3. The modular packaging and shipping assembly of claim 2, wherein each mounting platform leg extends from the bottom surface of the upper mounting member such that a vertical clearance is defined between the upper mounting member and the ground.

4. The modular packaging and shipping assembly of claim 2, wherein an upper mounting member groove is defined on the bottom of the upper mounting member of each of the plurality of mounting platforms.

5. The modular packaging and shipping assembly of claim 2, wherein the mounting platform legs are integrally connected to the bottom surface of the upper mounting member of each of the plurality of mounting platforms.

6. The modular packaging and shipping assembly of claim 3, wherein the vertical clearance is dimensioned to closely engage with forklift blades.

7. The modular packaging and shipping assembly of claim 1, wherein the width of each of the plurality of mounting adapters is equal or slightly less than the width of the bundled channels.

8. The modular packaging and shipping assembly of claim 1, wherein a mounting adapter groove is defined in the bottom surface of the mounting adapter such that a part of the strap is accommodated therein.

9. The modular packaging and shipping assembly of claim 1, wherein each of the plurality of mounting platforms is made out of plastic.

10. The modular packaging and shipping assembly of claim 1, wherein each of the plurality of straps is made out of plastic.

* * * * *